United States Patent [19]

Smegal et al.

[11] Patent Number: 5,008,003

[45] **Date of Patent: * Apr. 16, 1991**

[54] START-UP OF A HYDROREFINING PROCESS

[75] Inventors: John A. Smegal; Robert C. Ryan; Richard M. Nash, all of Houston, Tex.

[73] Assignee: Shell Oil Company, Houston, Tex.

[ * ] Notice: The portion of the term of this patent subsequent to Apr. 16, 2008 has been disclaimed.

[21] Appl. No.: 361,196

[22] Filed: Jun. 5, 1989

[51] Int. Cl.[5] ..... C10G 23/00

[52] U.S. Cl. ..... 208/254 H; 208/143; 208/209; 208/217; 208/251 H; 208/216 R

[58] Field of Search ..... 208/209, 216 R, 217, 208/251 H, 254 R, 143

[56] References Cited

U.S. PATENT DOCUMENTS

| | | | |
|---|---|---|---|
| 2,953,519 | 9/1960 | Bercik et al. | 208/143 |
| 2,954,339 | 9/1960 | Beavon | 208/216 |
| 3,053,758 | 9/1962 | Gerogs | 208/209 |
| 3,287,258 | 11/1966 | Mason | 208/254 H |
| 3,291,722 | 12/1966 | Taylor et al. | 208/254 H |
| 3,368,965 | 2/1968 | Schuman | 208/143 |
| 3,423,307 | 1/1969 | McKinney et al. | 208/213 |
| 3,528,910 | 9/1970 | Haney et al. | 208/216 |
| 3,953,321 | 4/1976 | Ganster et al. | 208/216 |
| 4,098,721 | 7/1978 | Ganster et al. | 252/439 |
| 4,149,965 | 4/1979 | Pine et al. | 208/216 |
| 4,485,006 | 11/1984 | Biceroglu | 208/216 |
| 4,547,285 | 10/1985 | Miller | 208/213 |
| 4,559,130 | 12/1985 | Reynolds et al. | 208/251 H |
| 4,560,465 | 12/1985 | Yu et al. | 208/251 H |
| 4,564,439 | 1/1986 | Kuehlei et al. | 208/251 H |

OTHER PUBLICATIONS

In Re Vogal and Vogel 1644 SPQ 619, Court of Customs and Patent Appeal.

*Primary Examiner*—Helane Myers

[57] ABSTRACT

The instant invention comprises an improved hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, optionally comprising a phosphorous-containing component or compound, and an alumina-containing support, at hydrorefining conditions, wherein the improvement comprises heating the catalyst in substantially non-sulfided form at initial start-up from a temperature below about 450° F. to hydrorefining temperature at an average rate of less than 30° F. per hour in the presence of hydrogen and a start-up hydrocarbonaceous oil feed having a sulfur content in the form of organosulfides of greater than 0.5 moles (basis elemental sulfur) per kilogram of start-up feed.

38 Claims, No Drawings

START-UP OF A HYDROREFINING PROCESS

FIELD OF THE INVENTION

This invention relates to a start-up procedure to be employed with a hydrorefining process, particularly a hydrodenitrification process, which provides for enhanced catalyst activity.

BACKGROUND OF THE INVENTION

Hydrorefining is a well-known process for upgrading a variety of hydrocarbon fractions. The term "hydrorefining" is used herein to designate a catalytic treatment in the presence of hydrogen of a hydrocarbonaceous oil in order to upgrade the oil by eliminating or reducing the concentration of contaminants in the oil such as sulfur compounds, nitrogenous compounds, metal contaminants and/or hydrogenation of hydrogen deficient hydrocarbons.

U.S. Pat. Nos. 3,953,321 and 4,098,721 disclose a hydrodesulfurization process for heavy hydrocarbonaceous oils such as gas oils in which a conventional hydrodesulfurization catalyst is sulfided and heat treated at a temperature of 750° F. to 850° F. prior to initiating the hydrodesulfurization. The catalyst is sulfided by contact with a lighter boiling range oil or is heat treated in the presence of the lighter oil, free from sulfur.

U.S. Pat. No. 2,954,339 discloses the use of a spent cobalt-molybdenum-alumina catalyst for hydrodesulfurization of a hydrocarbonaceous oil which may be a gas oil. Prior to contact with the gas oil, the catalyst is used to hydrotreat naphtha.

U.S. Pat. No. 3,423,307 discloses a start-up method for a hydrodesulfurization process for heavy residual feeds which contain asphaltic materials. The catalyst is initially contacted with an asphaltic-free feed.

U.S. Pat. No. 3,528,910 discloses a hydrotreating process for hydrocarbonaceous oils. A catalyst such as a supported nickel-molybdenum catalyst, is sulfided in the presence of hydrogen with a distillate containing disulfide sulfur prior to the hydrotreating reaction.

U.S. Pat. No. 4,149,965 discloses a start-up process for hydrorefining of naphtha. The catalyst is partially deactivated by treatment with a substantially non-metal containing hydrocarbon oil in the presence of hydrogen prior to contacting the catalyst with the naphtha feed.

U.S. Pat. No. 3,368,965 discloses a slurry hydrogenation process in which a catalyst, such as cobalt molybdate on alumina, is pretreated by wetting the catalyst with a clean (i.e., non-aromatic) hydrocarbonaceous oil such as a lubrication oil fraction to form a slurry which is then introduced into the hydrocarbonaceous oil to be hydrogenated.

U.S. Pat. No. 3,423,307 utilizes a start-up method comprising initially contacting a hydrorefining catalyst with hydrogen and an asphaltic-free hydrocarbon at a temperature from 250° F. to 500° F. and then gradually increasing the temperature until a temperature within the range of 600° F. and 700° F. is attained, following which hydrorefining of an asphaltic-containing feed is commenced.

U.S. Pat. No. 4,485,006 initiates the hydrorefining process by initially contacting a sulfided hydrorefining catalyst, such as nickel-molybdenum on alumina, with a light hydrocarbonaceous oil boiling in the range of $C_5$ to 700° F., in the presence of hydrogen, and thereafter contacting the catalyst with the heavy hydrocarbonaceous oil to be hydrorefined.

It has now been found that by utilizing the particular combination of slow start-up rate and liquid phase sulfiding with a high sulfur content hydrocarbon oil feed of the instant invention, enhanced catalyst activity can be obtained.

SUMMARY OF THE INVENTION

In accordance with the invention there is provided a hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, optionally comprising a phosphorous-containing compound, and an alumina-containing support, at hydrorefining conditions, the improvement which comprises heating the catalyst in substantially non-sulfided form at initial start-up from a temperature below about 450° F. to hydrorefining temperature at an average rate of less than 30° F. per hour in the presence of hydrogen and a start-up hydrocarbonaceous oil feed having a sulfur content in the form of organosulfides of greater than 0.5 moles (basis sulfur) per kilogram of start-up feed.

The start-up method of the instant invention results in the hydrorefining catalyst having a higher activity than occurs with a conventional fast start-up. The instant process is also more economic and requires fewer steps than the process of separately gas phase sulfiding of the catalyst followed by a liquid phase start-up. The instant start-up process is particularly suited to hydrodenitrification processes.

DETAILED DESCRIPTION OF THE INVENTION

The start-up method of the instant invention is suited for use at the beginning of a process for hydrorefining hydrocarbonaceous oil feeds in order to remove or reduce the concentration of contaminants in the oil such as sulfur compounds, nitrogenous compounds, metal contaminants and/or hydrogenation of hydrogen deficient hydrocarbons. Processes for removing nitrogen contaminants are particularly suited to the application of the method of the instant invention.

Suitable hydrorefining catalysts for use in the process comprise a hydrogenation component and an alumina-containing support. The hydrogenation component is selected from the group consisting of Group VIB metal component and a non-noble metal Group VIII metal component and mixtures thereof, such as cobalt, molybdenum, nickel, tungsten and mixtures thereof. The alumina-containing support may comprise a minor amount of another inorganic oxide such as silica, magnesia, boria, zirconia, strontia, hafnia, phosphorous oxide and mixtures thereof. Preferably the catalyst comprises molybdenum and/or tungsten and cobalt and/or nickel on an alumina support with a phosphorous-containing compound, particularly phosphorous oxide, optionally present. Catalyst preparative techniques are conventional and well known and can include impregnation, mulling, co-precipitation and the like, followed by calcination. These techniques, however, do not place the catalytic metals in the sulfided form which is the most active and desirable form. The method of the instant invention will place the catalyst in the sulfided form. The hydrorefining catalysts useful in the instant invention are well known in the art and reference can be made to the prior art, such as but not limited to U.S. Pat. No. 4,530,911 and U.S. Pat. No. 4,534,855 (both incorporated by reference herein) for more specific details about these types of catalysts.

Numerous hydrocarbonaceous oil feedstocks can be utilized in the instant hydrorefining process. Illustrative but non-limiting examples include gasoline fractions, kerosenes, jet fuel fractions, diesel fractions, light and heavy gas oils, deasphalted crude oil residua and the like, any of which may contain up to about 5 weight-percent of sulfur and up to about 3, usually about 0.02 to about 1.5 weight-percent of nitrogen.

Suitable hydrorefining operating conditions are summarized in Table I.

TABLE I

HYDROREFINING OPERATION CONDITIONS

| Conditions | Broad Range | Preferred Range |
|---|---|---|
| Temperature, °F. | 600–900 | 650–850 |
| Pressure, psig | 600–3500 | 800–3200 |
| Liquid hourly space velocity, V/V/HR | 0.05–5 | 0.1–2.5 |
| Hydrogen rate, SCF/BBL | 300–20,000 | 600–12,000 |
| Hydrogen partial pressure, psig | 500–3500 | 800–3000 |

The start-up hydrocarbonaceous oil feedstock can comprise the same or similar feedstock as those used in the hydrorefining process as indicated above. However, the start-up feedstock will normally contain a higher sulfur content in the form of organosulfides than the regular feedstock which high content may be obtained by "spiking" the regular feedstock with organosulfides. While naturally occurring high sulfur content feedstocks can be utilized, normally the high sulfur content will be obtained by adding organosulfides to feedstocks with less than the required sulfur content. Non-limiting examples of the organosulfides used to increase the content of the feed stock include mercaptan compounds, thiophenic compounds, organopolysulfides of the general formula R-$S_n$-R such as those disclosed in U.S. Pat. No. 4,530,917 (incorporated by reference herein), carbon sulfides such as carbon disulfide, and, preferably, dimethylsulfide (DMS) and dimethyldisulfide (DMDS).

The total amount of organosulfides is obtained by adding the amount intentionally added to the amount naturally occurring or already present in the feedstock. The total amount of organosulfides will be greater than about 0.5, preferably greater than 1, and more preferably greater than about 1.5 moles of sulfur, basis elemental sulfur, per kilogram of start-up feedstock. The amount of organosulfides in the start-up feedstock will range from about 0.5 to about 6, preferably from about 1 to about 5, more preferably from about 1.5 to about 3 moles of sulfur, basis elemental sulfur, per kilogram of start-up feedstock.

The catalyst may be disposed in the hydrorefining reaction zone as a fixed bed, moving bed, dispersed phase, fluidized bed, ebullating bed or a slurry. The method of the present invention is particularly suited for use in fixed bed processes.

In general terms, a hydrofining process utilizing the method of the instant invention will be carried out as follows. The unsulfided catalyst is loaded into the reactor. Hydrogen and a hydrocarbon feed is started to the reactor. The hydrocarbon feed may be the feed to be hydrorefined, the start-up feed per the instant invention, or any other hydrocarbon feed. In most cases this feed will be the feed to be hydrorefined. Next, the reactor is heated to a temperature below about 450° F. at a moderate rate, say, for example, at at rate of less than about 50° F. per hour. At this relatively low temperature only a minor amount of sulfiding of the catalyst will occur, and for purposes of this specification the catalyst is to be considered as in a substantially non-sulfided state. If the feed being circulated over the reactor has less than the desired amount of sulfur, "spiking" with organosulfide compounds will be begin at this point. The temperature may be allowed to rise slightly after spiking. An adequate distribution of sulfur-containing feed must be distributed over the catalyst bed prior to initiating the start-up of the instant process. An insufficiency of sulfur at high temperatures can result in the catalytic metals being reduced to the metallic state by the hydrogen present in the reactor with resulting deleterious effects on catalytic properties. Adequacy of sulfur distribution is ascertained by monitoring the sulfur concentration at the reactor outlet. When "breakthrough" of sulfur occurs, say, for example, when a concentration of 1000 ppm of sulfur is detected, then the start-up method of the instant process is commenced, heating to the hydrorefining temperature at an average rate of less than 30° F. per hour. Slower rates such as heating at less than 20° F. per hour or even 10° F. are also satisfactory. After reaching hydrorefining temperature, the feed is switched from the start-up feed to the feed to be hydrorefined. The reactor may be cooled slightly, say by about 50° F. below the expected start-of-run temperature, just before introduction of the normal feedstock. Variations in the general start-up procedure described above will be apparent to one of ordinary skill in the art to which this invention pertains.

In the start-up of the instant process, economic factors dictate that as fast a rate as possible which still maintains the high activity of the catalyst will be used in order to minimize non-productive start-up time. An other factor in determining start-up rates is the fact that when the catalyst is ready to be used to hydrorefine the feedstock, the catalyst must have been in contact with at least the stoichiometric amount of sulfur needed to sulfide the catalyst metals. Thus the sulfur content of the start-up feed can determine the start-up temperature rate. High sulfur contents in the start-up feedstock will allow faster heat-up rates to be used and vice versa. One skilled in the art will adjust both the sulfur content of the start-up feed and the start-up temperature in order to obtain complete sulfidation. To assure complete sulfidation of the catalyst, the catalyst may be held at hydrorefining conditions, say 650° F., while passing the start-up feed thereover for a period of time, say one hour, after breakthrough of sulfur has occurred at the reactor outlet sulfur contents.

The key aspect of the instant invention is heating the catalyst in substantially non-sulfided form from a temperature of less than about 450° F., or even of less than about 350° F. to hydrorefining conditions at an average temperature rate of increase of less than 30° F. per hour, of even less than about 20° F. per hour, or even yet less than about 10° F. per hour in the presence of a feedstock containing sulfur greater than about 0.5, preferably greater than about 1, and more preferably greater than about 1.5 moles of sulfur, basis elemental sulfur, per kilogram of start-up feedstock.

Hydrocarbon feed rates (LHSV) during start-up and during hydrorefining will generally range from about 0.1 to about 10, preferably from about 0.5 to about 5 liters/liter of catalyst/hour. Suitable rates are about 1–2 1/1/hr. The hydrogen flow will generally be adjusted to range from about 100 to about 10,000, preferably about 500 to about 5000, more preferably about 800 to about 2000 liters of hydrogen per liter of hydrocarbon feed. Hydrogen partial pressures will range from about 500 to about 5000 psi.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

The following examples are provided in order to illustrate the invention and are not to be construed as limiting the invention.

ILLUSTRATIVE EMBODIMENTS

The catalyst testing was performed in a pilot scaled reactor using 100 cc of whole pellets. The catalyst was diluted with 60–80 mesh SiC to minimize feed channelling and allow for uniform isothermal operation of the reactor. The start-up feed was prepared from Feed B in Table 1 by adding 10 grams of dimethyldisulfide to 100 grams of Feed B.

The operating procedure was as follows. The catalyst was loaded into the reactor and the reactor was heated up under a hydrogen flow rate of about 95 liters/hr to about 200° F. and the start-up feed was fed to the reactor. Once the catalyst was wetted, the temperature was held at 200° F. for one hour. The temperature was then increased to 400° F. and held for one hour. At this point, the programmed start-up procedure of the instant invention was utilized whereby the temperature was increased 30° F. per 3 hours until a temperature of 650° F. was obtained. The run was continued under these conditions until the start-up feed was exhausted (14.5 hrs.), at which point Feed A (Table 1) was fed to the reactor. Operating pressure was maintained at about 1750 psig. Feed flow rates were maintained at about 1 liter per liter of catalyst per hour.

To measure the catalyst activity, the initial hydrorefining temperature required to provide a product having a residual nitrogen impurity level of 5 ppm was determined. This is referred to as the "Start-of-Run Temperature". This determines the activity of the catalyst for hydrodenitrification. The higher the temperature the poorer the activity. The Start-of-Run temperature was determined to be 664° F.

For comparative purposes a catalyst as described above was presulfided using 95/5 v% hydrogen/hydrogen sulfide and was tested using a conventional 6 hour start-up (from 400° F. to hydrorefining temperature @ 50° F. per hour). The Start-of-Run Temperature was determined to be 676° F.

From a comparison of the Start-of-Run Temperatures it can be seen that the start-up method of the instant invention results in a more active catalyst by at least 10° F. for hydrodenitrification than does the conventional 6 hour start-up.

TABLE 1

| FEED | A | B |
|---|---|---|
| FEED TYPE | 10% KHGO[a] | 100% SRHGO[c] |
| | 77% CCLGO[b] | |
| | 9% SRHGO[c] | |
| | 4% KLGO[d] | |
| ELEMENTAL ANALYSIS: | | |
| CARBON (WT %) | 88.053 | 86.862 |
| HYDROGEN (WT %) | 10.980 | 12.694 |
| SULFUR (WT %) | 0.434 | 0.3340 |
| NITROGEN (WT %) | 0.271 | 0.0580 |
| OXYGEN (WT %) | 0.226 | 0.1740 |
| DENSITY (60° F.) | 0.9270 | 0.8881 |
| MOLECULAR WT | 219.0 | — |
| BROMINE NUMBER | — | — |
| RI @ 20° C. | — | 1.4867 |
| °API | — | — |
| AROMATICS INDEX | — | — |
| VISCOSITY CS (40° C.) | — | 16.3 |
| UV AROMATICS, % WT OF TOTAL C: | | |
| BENZENE | — | 5.72 |
| NAPHTHALENES | — | 14.50 |
| PHENANTHRENES | — | 13.41 |
| CONDENSED TETRAAROMATICS | — | 2.49 |
| TOTAL | — | 36.12 |
| DISTILLATION, TBP-GLC (°F.) | | |
| IBP | 276 | 270 |
| 5% | — | — |
| 10% | 452 | 420 |
| 20% | — | 464 |
| 30% | 518 | 496 |
| 40% | — | 527 |
| 50% | 571 | 558 |
| 60% | — | 587 |
| 70% | 622 | 616 |
| 80% | — | 648 |
| 90% | 684 | 687 |
| 95% | 708 | 716 |
| 98% | 734 | 752 |
| 99% | 753 | — |
| 99.5% | 885 | 811 |
| BASIC NITROGEN (ppm) | 664 | — |
| Ni (ppm) | <.1 | — |
| V (ppm) | <.1 | — |
| Na (ppm) | <.1 | — |
| RCR (wt %) | 0.19 | — |
| S (wt %) | — | 0.334 |

[a]Flexicoker Heavy Gas Oil
[b]Catalytically Cracked Light Gas Oil
[c]Straight Run Heavy Gas Oil
[d]Flexicoker Light Gas Oil
[e]Catalytically Cracked Heavy Gas Oil

What is claimed is:

1. In a hydrorefining process which comprises contacting hydrocarbonaceous oil feed and hydrogen with a catalyst comprising a hydrogenation component selected from the group consisting of Group VIB metal component, Group VIII non-noble metal component and mixtures thereof, and an alumina-containing support, at hydrorefining conditions, the improvement which comprises heating the catalyst in substantially non-sulfided form at initial start-up from a temperature below about 450° F. to hydrorefining temperature at an average rate of less than about 10° F. per hour in the presence of hydrogen and a start-up hydrocarbonaceous oil feed having a sulfur content in the form of organosulfides of greater than 0.5 moles (basis elemental sulfur) per kilogram of start-up feed.

2. The process of claim 1 wherein said hydrorefining conditions include a temperature ranging from about 600° F. to about 900° F. and a total pressure ranging from about 600 to about 3500 psig.

3. The process of claims 1 or 2 wherein the hydrogenation component comprises a metal selected from the group consisting of nickel, cobalt, molybdenum, tungsten, and mixtures thereof.

4. The process of claim 3 wherein the support comprises gamma alumina.

5. The process of any one of claims 1, 2 or 4 wherein the catalyst additionally comprises a phosphorus-containing component.

6. The process of claim 5 wherein the sulfur content of the start-up feed is greater than about 1 moles per kilogram of start-up feed.

7. The process of claim 6 wherein the sulfur content of the start-up feed is greater than about 1.5 moles per kilogram of start-up feed.

8. The process of claim 5 wherein the sulfur content of the start-up feed ranges from about 0.5 to about 6 moles per kilogram of start-up feed.

9. The process claim 8 wherein the sulfur content of the start-up feed ranges from about 1 to about 5 moles per kilogram of start-up feed.

10. The process claim 9 wherein the sulfur content of the start-up feed ranges from about 1.5 to about 3 moles per kilogram of start-up feed.

11. The process of any one of claims 1, 2 or 4 wherein the sulfur content of the start-up feed is greater than about 1 moles per kilogram of start-up feed.

12. The process of claim 11 wherein the sulfur content of the start-up feed is greater than about 1.5 moles per kilogram of start-up feed.

13. The process of any one of claims 1, 2 or 4 wherein the sulfur content of the start-up feed ranges from about 0.5 to about 6 moles per kilogram of start-up feed.

14. The process claim 13 wherein the sulfur content of the start-up feed ranges from about 1 to about 5 moles per kilogram of start-up feed.

15. The process claim 14 wherein the sulfur content of the start-up feed ranges from about 1.5 to about 3 moles per kilogram of start-up feed.

16. The process of claim 1 wherein the catalyst at initial start-up is heated from a temperature below about 350° F. to hydrorefining temperature at an average rate of less than 10° F. per hour.

17. The process of claim 16 wherein said hydrorefining conditions include a temperature ranging from about 600° F. to about 900° F. and a total pressure ranging from about 600 to about 3500 psig.

18. The process of claims 16 or 17 wherein the hydrogenation component comprises a metal selected from the group consisting of nickel, cobalt, molybdenum, tungsten, and mixtures thereof.

19. The process of claim 18 wherein the support comprises gamma alumina.

20. The process of claim 19 wherein the catalyst additionally comprises a phosphorous component.

21. The process of any one of claims 19 or 20 wherein the sulfur content of the start-up feed is greater than about 1 moles per kilogram of start-up feed.

22. The process of claim 21 wherein the sulfur content of the start-up feed is greater than about 1.5 moles per kilogram of start-up feed.

23. The process of any one of claims 19–20 wherein the sulfur content of the start-up feed ranges from about 0.5 to about 6 moles per kilogram of start-up feed.

24. The process claim 23 wherein the sulfur content of the start-up feed ranges from about 1 to about 5 moles per kilogram of start-up feed.

25. The process claim 24 wherein the sulfur content of the start-up feed ranges from about 1.5 to about 3 moles per kilogram of start-up feed.

26. A method for starting up a hydrorefining process for a nitrogen impurity-containing hydrocarbonaceous oil feed which comprises:

(a) contacting a hydrorefining catalyst comprising a hydrogenation component selected from the group consisting of nickel, cobalt, molybdenum, tungsten and mixtures thereof in substantially non-sulfided form on an alumina-containing support with hydrogen and a start-up hydrocarbonaceous oil feed having a sulfur content in the form of organosulfides of greater than about 0.5 moles (basis elemental sulfur) per kilogram of start-up feed at a total pressure ranging from about 800 to about 3000 psig and at a temperature below about 450° F. and heating the catalyst to hydrorefining conditions comprising a temperature ranging from about 600° F. to about 700° F. and a total pressure ranging from about 800 to about 3000 psig at an average rate of temperature increase of less than 10° F. per hour (b) contacting the catalyst with hydrogen and said nitrogen impurity-containing hydrocarbonaceous oil feed at hydrorefining conditions, and (c) thereafter recovering a hydrorefined hydrocarbonaceous oil having a reduced level of nitrogen impurities.

27. The process of claim 26 wherein the support comprises gamma alumina.

28. The process of any one of claims 26–27 wherein the catalyst additionally comprises a phosphorous-containing component.

29. The process of any one of claims 26–27 wherein the sulfur content of the start-up feed is greater about 1 moles per kilogram of start-u feed.

30. The process of claim 29 wherein the sulfur content of the start-up feed is greater about 1.5 moles per kilogram of start-up feed.

31. The process of any one of claims 26–27 wherein the sulfur content of the start-up feed ranges from about 0.5 to about 6 moles per kilogram of start-up feed.

32. The process claim 31 wherein the sulfur content of the start-up feed ranges from about 1 to about 5 moles per kilogram of start-up feed.

33. The process claim 32 wherein the sulfur content of the start-up feed ranges from about 1.5 to about 3 moles per kilogram of start-up feed.

34. The process of claim 28 wherein the sulfur content of the start-up feed is greater about 1 moles per kilogram of start-up feed.

35. The process of claim 34 wherein the sulfur content of the start-up feed is greater about 1.5 moles per kilogram of start-up feed.

36. The process of claim 28 wherein the sulfur content of the start-up feed ranges from about 0.5 to about 6 moles per kilogram of start-up feed.

37. The process claim 36 wherein the sulfur content of the start-up feed ranges from about 1 to about 5 moles per kilogram of start-up feed.

38. The process claim 37 wherein the sulfur content of the start-up feed ranges from about 1.5 to about 3 moles per kilogram of start-up feed.

* * * * *